United States Patent [19]

Kluczny

[11] Patent Number: 4,747,597

[45] Date of Patent: May 31, 1988

[54] AUXILIARY BASKETBALL BACKBOARD AND HOOP

[76] Inventor: Raymond M. Kluczny, 1112 Sycamore, Rolla, Mo. 65401

[21] Appl. No.: 87,304

[22] Filed: Aug. 20, 1987

[51] Int. Cl.[4] ..... A63B 63/08

[52] U.S. Cl. ..... 273/1.5 R

[58] Field of Search ..... 273/1.5 R, 1.5 A; D21/201

[56] References Cited

U.S. PATENT DOCUMENTS

| | | | |
|---|---|---|---|
| 1,544,453 | 6/1925 | Harbison | 273/1.5 R |
| 2,219,528 | 10/1940 | Osness | 273/1.5 R |
| 2,707,104 | 4/1955 | Killick | 273/1.5 R |
| 2,808,264 | 10/1957 | Scalf | 273/1.5 A |
| 4,330,101 | 5/1982 | Andersen | 273/1.5 R X |
| 4,508,337 | 4/1985 | Gillespie, Jr. | 273/1.5 R |
| 4,643,422 | 2/1987 | Cramblett | 273/1.5 R |

*Primary Examiner*—Paul E. Shapiro

*Attorney, Agent, or Firm*—Senniger, Powers, Leavitt and Roedel

[57] ABSTRACT

An auxiliary basketball backboard and hoop unit for installation on a standard basketball hoop mounted by a horizontal plate to a standard backboard, comprising an auxiliary backboard and an auxiliary hoop mounted on the front of the auxiliary backboard. A pair of elongate supports extends upwardly from the auxiliary backboard, each support having a hook at its upper end adapted to engage the forward portion of the standard hoop on generally opposite sides thereof. The unit further comprises a brace having upper and lower portions. The lower portion is pivotally connected to the back of the auxiliary backboard and the upper portion is adapted to engage the corner formed between the standard backboard and the plate mounting the standard hoop. A bungi cord may be provided for resiliently biasing the brace toward the supports.

20 Claims, 4 Drawing Sheets

AUXILIARY BASKETBALL BACKBOARD AND HOOP

BACKGROUND OF THE INVENTION

This invention relates to basketball equipment and in particular to an auxiliary baasketball backboard and hoop unit for mounting on a standard basketball hoop to provide a smaller and lower hoop for younger players.

Various basketball goal devices have been designed that permit the height of the goal to be adjusted. Examples of such devices are shown in U.S. Pat. Nos. 4,526,367, 4,522,394, 4,508,337, 4,395,040, 4,218,058, 4,183,522, 2,986,395, 2,707,104. However, these devices are usually large, complex, and expensive. Most of these devices are not adapted to be retrofit to existing basketball goals. While some devices have been designed to be retrofit on standard basketball goals, these have typically been cumbersome and difficult to install. These devices are often bulky and hard to handle and store. Because of their size and/or method of attachment, the installer may require assistance and ladders and tools may be needed. Another disadvantage with these devices is that there is often no provision for adjusting the height of the auxiliary hoop to adapt them for use by younger and shorter players.

SUMMARY OF THE INVENTION

It is therefore among the objects of this invention to provide an auxiliary basketball backboard and hoop unit for mounting on a standard basketball hoop to provide a smaller and lower hoop; to provide such a unit that is of simple and inexpensive construction; to provide such a unit that is light weight and easy to handle; to provide such a unit that can be quickly and easily installed and removed without need for assistance or for ladders or tools. It is further among the objects of at least one embodiment of this invention to provide an auxiliary basketball backboard and hoop unit that can be easily adjusted to different heights.

The auxiliary backboard and hoop unit of the present inventin is adapted for installation on a standard basketball hoop of the type mounted by a horizontal plate to a standard backboard. Generally this unit comprises an auxiliary backboard and an auxiliary hoop mounted on the front of the auxiliary backboard. A pair of elongate supports extend upwardly from the auxiliary backboard. Each support has a hook at its upper end, these hooks are adapted to, and are spaced to, engage the forward portion of the standard hoop on generally opposite sides. The unit further comprises a brace having upper and lower portions. The lower portion is pivotally connected to the back of the auxiliary backboard. The upper portion is adapted to engage the corner formed between the standard backboard and the plate mounting the standard hoop. The auxiliary backboard and hoop unit may also include means for resiliently biasing the brace toward the supports. This biasing means may be, for example a resilient member extending between at least one of the supports and the brace.

The lower potion of the brace preferably branches into two lower ends, each pivotally connected to the auxiliary backboard at laterally spaced apart locations along a horizontal line. Each of these lower ends of the brace is preferably attached to the auxiliary backboard generally adjacent one of the supports. These ends are preferably connected to the auxiliary backboard at the level of the auxiliary hoop.

In an alternate embodiment, the lengths of the supports and the brace are adjustable to permit adjustment of the height of the auxiliary backboard and hoop. The supports and the brace preferably have a telescoping construction.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
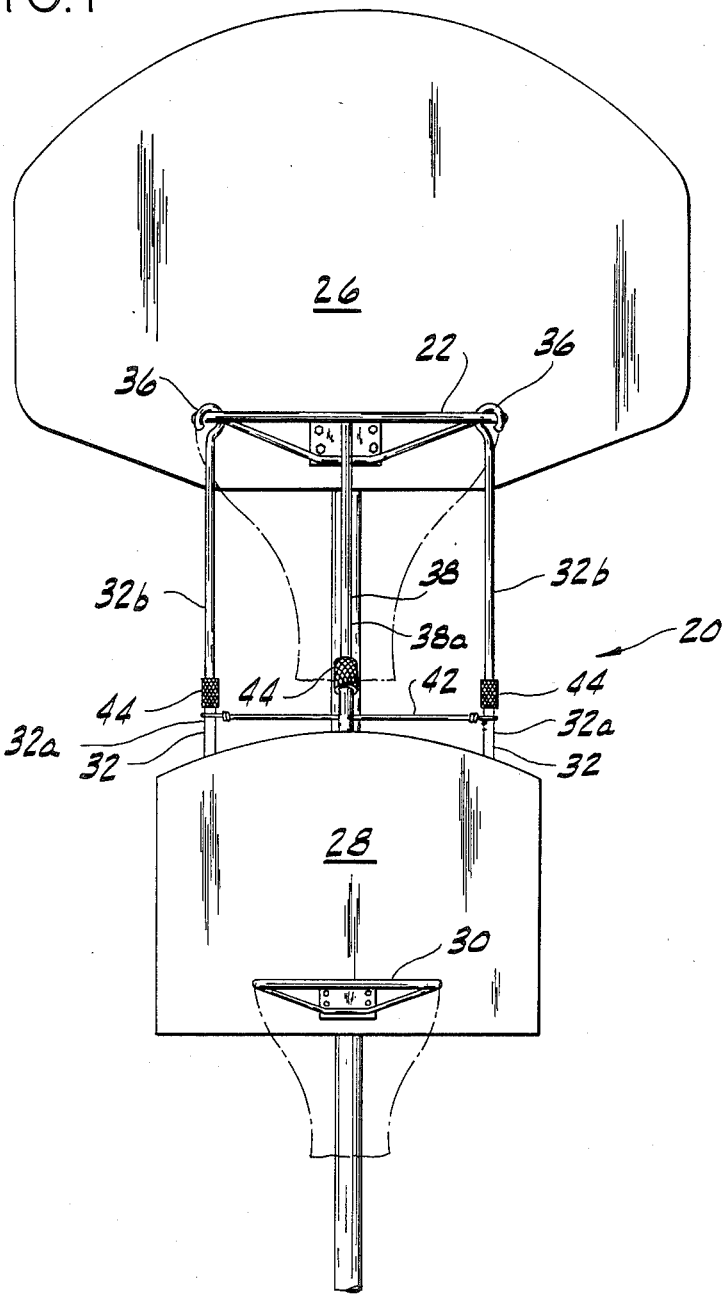
FIG. 1 is a front elevation view of an auxiliary basketball backboard and hoop unit, constructed according to the principles of this invention, shown as it would be installed on a standard basketball hoop and backboard.
Figure 2:
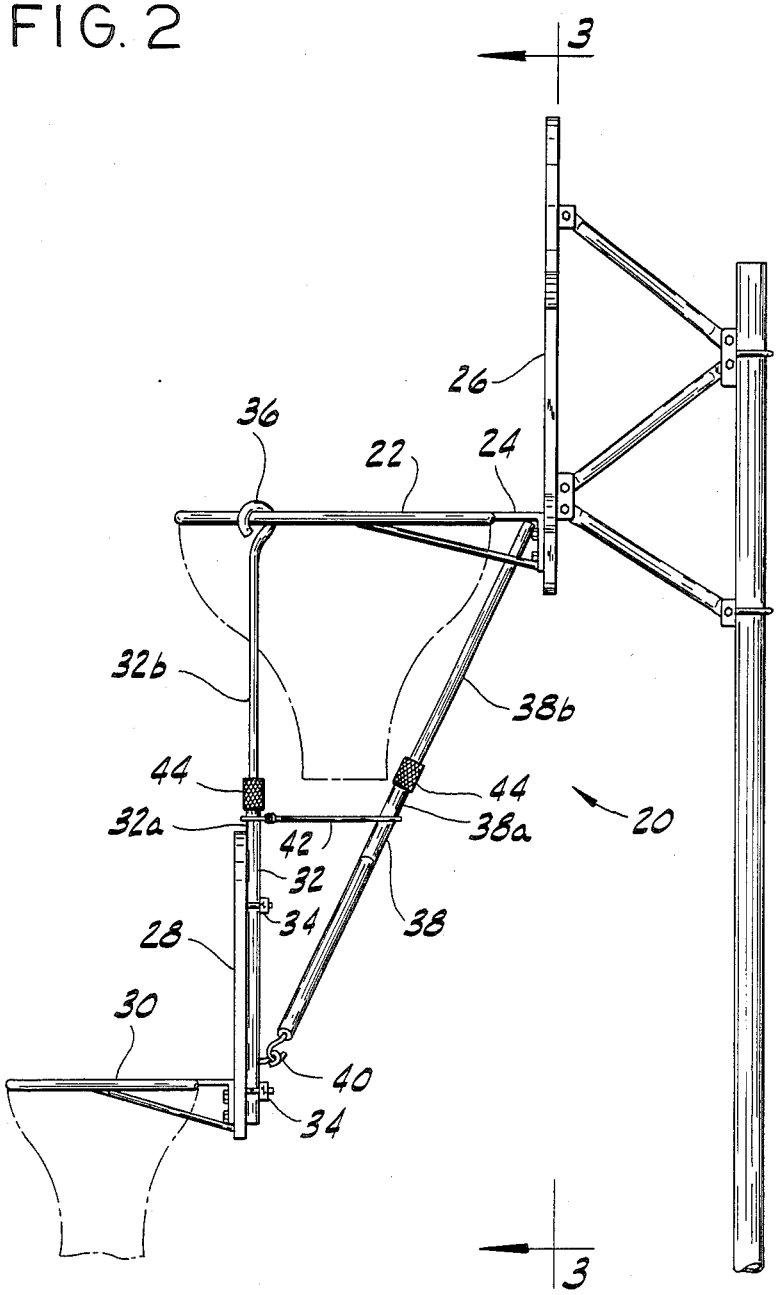
FIG. 2 is a side elevation view of the unit and the standard hoop and backboard.
Figure 3:
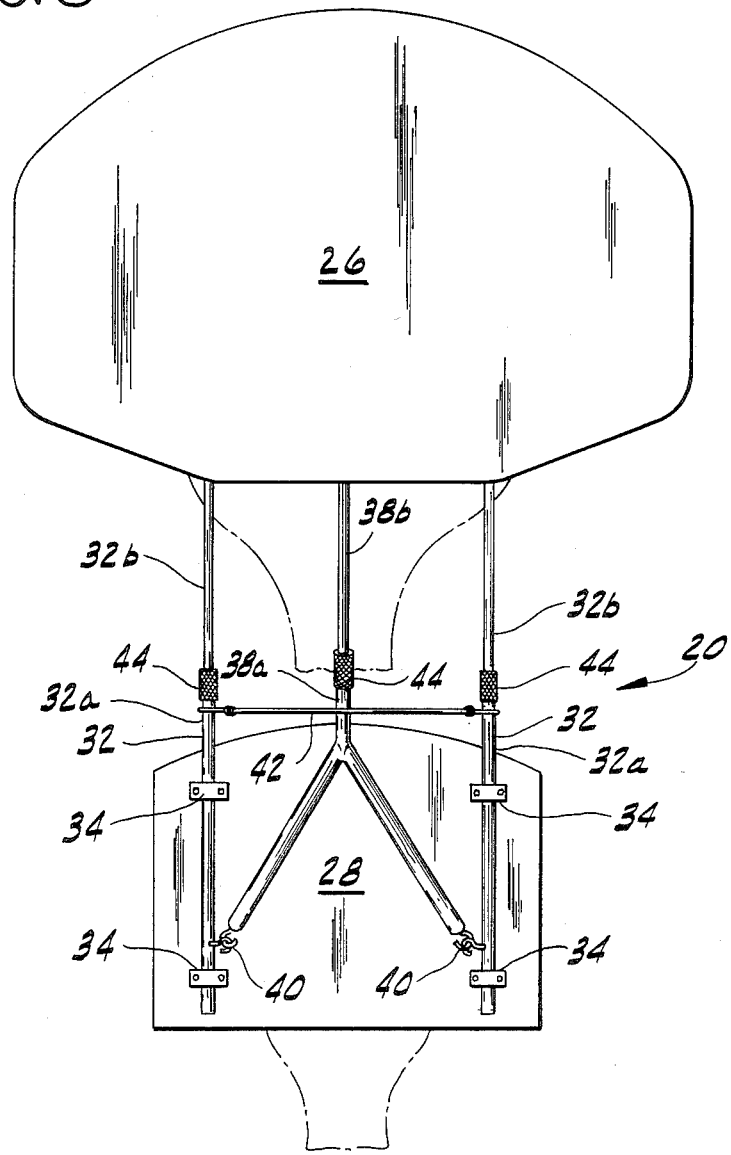
FIG. 3 is a cross sectional view taken along the plane of line 3—3 in FIG. 2, showing the unit and the standard hoop and backboard in rear elevation.

An auxiliary basketball backboard and hoop unit constructed according to the principles of this invention is indicated generally as 20 in FIGS. 1–3. The unit 20 is shown as it would be installed on a standard basketball hoop 22, which is mounted by a horizontal plate 24 to a standard backboard 26, to provide a lower and smaller backboard and hoop for younger players.

The unit 20 comprises an auxiliary backboard 28 and an auxiliary hoop 30 mounted on the front of the auxiliary backboard. As shown in the figures, the auxiliary backboard and hoop are preferably scaled down to size relative to the standard backboard and hoop. Two elongate supports 32 extend generally upwardly from the auxiliary backboard 28. The supports extend down the back of the auxiliary backboard, over substantially its entire height. The supports can be secured to the backboard adjacent the top and bottom edges with U-shaped clamps 34. Each support 32 has a hook 36 at its upper end. These hooks 36 are adapted to, and are spaced from each other to, engage the forward portion of the standard hoop 22 on generally opposite sides thereof.

The unit 20 further comprises a brace 38 having upper and lower portions. The lower portion of brace 38 is pivotally connected to the back of the auxiliary backboard to pivot about a horizontal axis. The lower portion of the brace 38 preferably branches into two lower ends. Brace 38 may be shaped generally like an inverted "V", as described more completely below, or preferably, as shown in best in FIG. 3, like an inverted "Y". Each of the ends is pivotally connected to the auxiliary backboard at laterally spaced points on a horizontal line, each preferably adjacent one of the supports 32. The lower ends of the brace are preferably connected to the auxiliary backboard at the same vertical level as the auxiliary hoop. The ends may be connected to the auxiliary backboard with interlocking eyeltes 40, or some other suitable means, for example hinges, could be used. The upper portion of brace 38 is adapted to engage the corner formed between the standard backboard 26 and the plate 24 mounting the standard hoop 22 to the backboard 26.

The unit 20 preferably includes means for resiliently biasing the brace 38 toward the supports and the brace. In the preferred embodiment this biasing means is a resilient member such as bungi cord 42 extending from one of the supports 32 around the brace to the other of the supports 32.

In an alternate embodiment shown in the figures, the lengths of the supports 32 and of the brace 38 can be made adjustable, to permit adjustment of the height of the auxiliary backboard and hoop. As shown best in FIGS. 1 and 3, the supports 32 telescope, having first portions 32*a* and second portions 32*b* of smaller cross section that fit within the first portions. A compression device, such knurled threaded collars 44, can be provided to fix the portions 32*a* and 32*b* relative to each other and thereby fix the length of the supports. Likewise brace 38 can telescope, the stem of the "Y" comprising a first portion 38*a* and a second portion 38*b* of smaller cross section that fits within the first portion. A threaded collar 44 is also provided to fix the portions 38*a* and 38*b* relative to each other and thereby fix the length of the brace.

Figure 4:
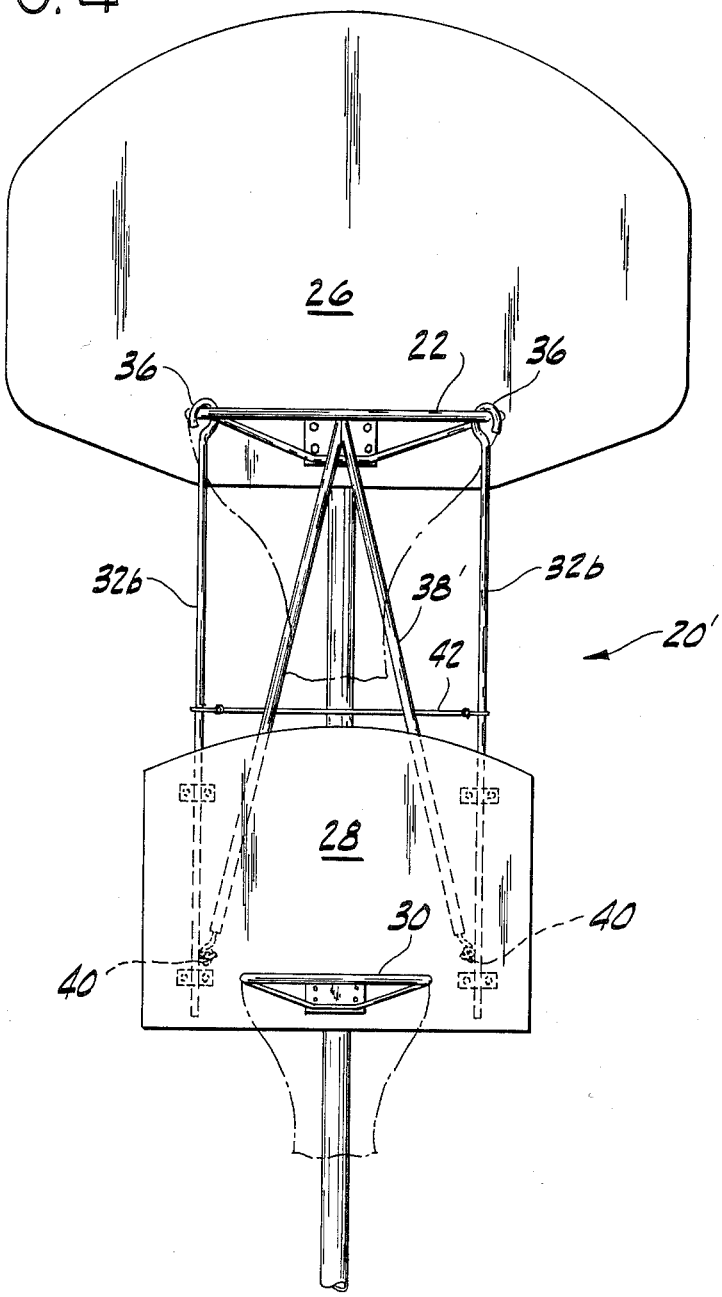
FIG. 4 is a front elevation view of a second embodiment of an auxiliary basketball backboard and hoop unit, constructed according to the principles of this invention, shown as it would be installed on a standard basketball hoop and backboard.

A second embodiment of an auxiliary basketball backboard and hoop unit is indicated generally as 20' in FIG. 4. Unit 20' is similar to unit 20, with corresponding parts identified with corresponding reference numerals. Unit 20' differs from unit 20 in that instead of an inverted Y-shaped brace 38, unit 20' has an inverted V-shaped brace 38'. The ends of the brace 38' are pivotally connected to the auxiliary backboard at laterally spaced points on a horizontal line, each preferably adjacent one of the supports 32. The lower ends of the brace are preferably connected to the auxiliary backboard at the same vertical level as the auxiliary hoop. The ends may be connected to the auxiliary backboard with interlocking eyelets 40, or some other suitable means, for example hinges, could be used. The upper portion of V-shaped brace 38' is adapted to engage the corner formed between the standard backboard 26 and the plate 24 mounting the standard hoop 22 to the backboard 26.

OPERATION

The auxiliary basketball backboard and hoop unit 20 can be quickly and easily installed on a standard hoop without need for assistance, ladders, or tools. The desired length of the supports 32 and brace 38 is first selected by telescoping the supports to the desired length and fixing their length by tightening collars 44. The unit 20 is then manipulated to engage the hooks 36 on the upper ends of the supports to the front portion of the standard hoop 22, on opposite sides. Some adjustment of the length of brace 38 may be necessary. This is accomplished by telescoping the brace 38 to its desired length and fixing the length by tightening collar 44. The upper end of the brace 38 is then manipulated into the corner formed between the the standard backboard 26 and the plate 24 mounting the standard hoop 22 to the backboard 26. Bungi cord 42 is then stretched from one of the supports, around the brace 36 to the other support to rigidify the unit.

The unit is thus ready for use. The unit can be quickly and easily removed by reversing the above steps. The unit can be conveniently stored by collapsing the telescoping supports and brace, and folding the brace toward the supports, to occupy a minimum of space.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. An auxiliary basketball backboard and hoop unit for installation on a standard basketball hoop mounted by a horizontal plate to a standard backboard to provide a lower and smaller backboard and hoop for juvenile use the unit comprising:

an auxiliary backboard;

an auxiliary hoop mounted on the front of the auxiliary backboard;

a pair of elongate supports extending upwardly from the auxiliary backboard, each support having a hook at its upper end, the hooks being adapted to, and spaced to, engage the forward portion of the standard hoop on generally opposite sides thereof;

a brace having upper and lower portions, the lower portion pivotally connected to the back of the auxiliary backboard to pivot about a horizontal axis, and the upper portion adapted to engage the corner formed between the standard backboard and the plate mounting the standard hoop.

2. The auxiliary backboard and hoop unit according to claim 1 further comprising means for resiliently biasing the brace toward the supports.

3. The auxiliary backboard and hoop unit according to claim 2 wherein the resilient biasing means comprises a resilient member extending between at least one of the supports and the brace.

4. The auxiliary backboard and hoop unit according to claim 2 wherein the lower portion of the brace is branched, having two ends pivotally connected to the auxiliary backboard along a horizontal line at laterally spaced apart locations.

5. The auxiliary backboard and hoop unit according to claim 4 wherein the brace is shaped like an inverted "V".

6. The auxiliary backboard and hoop unit according to claim 4 wherein the brace is shaped like an inverted "Y".

7. The auxiliary backboard and hoop unit according to claim 1 wherein the lengths of the supports and of the brace are adjustable to adjust the height of the auxiliary backboard and hoop.

8. An auxiliary basketball backboard and hoop unit for installation on a standard basketball hoop mounted by a horizontal plate to a standard backboard to provide a lower and smaller backboard and hoop for juvenile use, the unit comprising:

an auxiliary backboard;

an auxiliary hoop mounted on the front of the auxiliary backboard;

a pair of telescoping elongate supports extending upwardly from the auxiliary backboard, each elongate support having a hook at its upper end, the hooks being adapted to, and spaced from each other sufficiently to, engage the forward portion of the standard hoop on generally opposite sides thereof;

a telescoping brace having upper and lower portions, the lower portion pivotally connected to the back of the auxiliary backboard to pivot about a horizontal axis, and the upper portion adapted to engage the corner formed between the standard backboard and the plate mounting the standard hoop; and means for resiliently biasing the brace toward the supports.

9. The auxiliary backboard and hoop unit according to claim 8 wherein the resilient biasing means comprises a resilient member extending between at least one of the supports and the brace.

10. The auxiliary backboard and hoop unit according to claim 9 wherein the resilient biasing means is a bungi cord extending from one of the supports, around the brace to the other of the supports.

11. The auxiliary backboard and hoop unit according to claim 8 wherein the lower portion of the brace is branched, having two ends pivotally connected to the auxiliary backboard along a horizontal line at laterally spaced apart locations.

12. The auxiliary backboard and hoop unit according to claim 11 wherein the brace is shaped like an inverted "Y" and the stem of the "Y" telescopes.

13. The auxiliary backboard and hoop unit according to claim 11 wherein the lower ends of the rear brace are pivotally connected to the auxiliary backboard at the same level as the auxiliary hoop.

14. The auxiliary backboard and hoop unit according to claim 11 wherein the each of the lower ends of the brace is pivotally connected to the auxiliary backboard generally adjacent one of the supports.

15. In combination with a standard basketball hoop mounted by a horizontal plate to a standard backboard, an auxiliary basketball backboard and hoop unit to provide a lower and smaller backboard and hoop for juvenile use, comprising:

an auxiliary backboard;

an auxiliary hoop mounted to the front of the auxiliary backboard;

a pair of elongate supports extending upwardly from the auxiliary backboard, each elongate support having a hook at its upper end engaging the forward portion of the standard hoop on generally opposite sides thereof;

a brace having upper and lower portions, the lower portion being pivotally connected to the back of the auxiliary backboard to pivot about a horizontal axis, and the upper portion engaging the corner formed between the standard backboard and the plate mounting the standard hoop; and means for resiliently biasing the brace toward the supports.

16. The combination according to claim 15 wherein the resilient biasing means comprises a resilient member extending between at least one of the supports and the brace.

17. The combination according to claim 15 wherein the lower portion of the brace is branched, having two lower ends pivotally connected to the auxiliary backboard along a horizontal line at laterally spaced apart locations.

18. The combination according the claim 17 wherein the brace is shaped like an inverted "Y".

19. The auxiliary backboard and hoop unit according to claim 17 wherein the lower ends of the rear brace are pivotally mounted to the auxiliary backboard at the same level as the auxiliary hoop.

20. The combination according to claim 15 wherein the lengths of the supports and of the brace are adjustable to adjust the height of the auxiliary backboard and hoop.

* * * * *